US009144283B2

(12) United States Patent
Ribeiro da Silva

(10) Patent No.: US 9,144,283 B2
(45) Date of Patent: Sep. 29, 2015

(54) AIR JET HAIR ROLLERS

(71) Applicant: Adriana Ribeiro da Silva, Goânia-Goiás (BR)

(72) Inventor: Adriana Ribeiro da Silva, Goânia-Goiás (BR)

( * ) Notice: Subject to any disclaimer, the term of this patent is extended or adjusted under 35 U.S.C. 154(b) by 0 days.

(21) Appl. No.: 14/286,664

(22) Filed: May 23, 2014

(65) Prior Publication Data

US 2014/0345642 A1 Nov. 27, 2014

Related U.S. Application Data

(63) Continuation-in-part of application No. PCT/BR2012/000414, filed on Oct. 3, 2012.

(30) Foreign Application Priority Data

Nov. 24, 2011 (BR) ..... 9103006 U

(51) Int. Cl.
*A45D 6/06* (2006.01)
*A45D 6/16* (2006.01)
(Continued)

(52) U.S. Cl.
CPC *A45D 2/122* (2013.01); *A45D 2/12* (2013.01); *A45D 2/148* (2013.01); *A45D 2/36* (2013.01); *A45D 4/10* (2013.01); *A45D 4/18* (2013.01)

(58) Field of Classification Search
CPC ..... A45D 2/06; A45D 2/08; A45D 2/122; A45D 2/12; A45D 2/36; A45D 2/148; A45D 2/146; A45D 2/22; A45D 2/362; A45D 2/367; A45D 4/18; A45D 4/04; A45D 4/06; A45D 4/10; A45D 4/12
USPC ..... 132/267, 200, 203, 206, 207, 210, 211, 132/212, 223, 226–229, 230, 245–247, 132/250–252, 257–266, 268, 269, 253; 219/222, 227–229; 392/380, 383; 34/283, 96, 101; D28/11, 37, 38
See application file for complete search history.

(56) References Cited

U.S. PATENT DOCUMENTS 1,560,894 A * 11/1925 Blum et al. ..... 132/228
1,667,726 A * 5/1928 Fayer ..... 219/480
(Continued)

FOREIGN PATENT DOCUMENTS

BR 7302065 10/1994
JP 2006230538 9/2006

OTHER PUBLICATIONS

International Search Report for PCT/BR2012/000414 dated Jan. 16, 2013.
(Continued)

*Primary Examiner* — Vanitha Elgart
(74) *Attorney, Agent, or Firm* — B. Aaron Schulman, Esq.; Stites & Harbison, PLLC.

(57) ABSTRACT

A hair roller includes a tubular body having a generally cylindrical outer wall and defining a hollow chamber therewithin, first and second generally circular end closures respectively sealing first and second longitudinal ends of the tubular body to prevent air flow therethrough, and an annular adapter. The outer wall has a first hole and a plurality of vent openings formed therethrough. The first hole is configured to receivably engage a first open end of the adapter. A second open end of the adapter is configured to interconnect with a first end of a conduit such that, upon the first hole receivably engaging the first open end of the adapter, the adapter facilitates a flow of air being delivered from the conduit through the outer wall into the hollow chamber via the first hole and out of the hollow chamber through the outer wall via the vent openings.

5 Claims, 3 Drawing Sheets

(51) Int. Cl.

| | |
|---|---|
| ***A45D 2/12*** | (2006.01) |
| ***A45D 4/10*** | (2006.01) |
| ***A45D 2/14*** | (2006.01) |
| ***A45D 2/36*** | (2006.01) |
| ***A45D 4/18*** | (2006.01) |

(56) References Cited

U.S. PATENT DOCUMENTS

| | | | | | |
|---|---|---|---|---|---|
| 1,711,177 | A | * | 4/1929 | Rene | 132/228 |
| 1,718,133 | A | * | 6/1929 | Gaire | 132/228 |
| 1,894,431 | A | * | 1/1933 | Vaghelatos | 132/229 |
| 1,939,323 | A | * | 12/1933 | Slavick | 132/211 |
| 1,943,889 | A | * | 1/1934 | Gentile | 132/211 |
| 2,104,897 | A | * | 1/1938 | Decker | 132/211 |
| 2,203,268 | A | * | 6/1940 | Morrow et al. | 132/251 |
| 2,263,718 | A | * | 11/1941 | Cowan | 219/224 |
| 2,772,681 | A | * | 12/1956 | Swenson et al. | 132/251 |
| 3,199,218 | A | * | 8/1965 | Bean | 34/98 |
| 3,347,248 | A | * | 10/1967 | Weitzner | 132/252 |
| 3,476,121 | A | * | 11/1969 | Foley | 132/229 |
| D226,587 | S | * | 3/1973 | Keldmann | D28/37 |
| 5,487,396 | A | * | 1/1996 | Wilson | 132/248 |
| 5,740,820 | A | * | 4/1998 | Stern | 132/249 |
| 5,791,356 | A | * | 8/1998 | Muzzipapa | 132/250 |
| 6,107,604 | A | | 8/2000 | Hibri et al. | |
| 6,314,968 | B1 | * | 11/2001 | Navarro | 132/248 |
| 2003/0000541 | A1 | * | 1/2003 | Smith | 132/210 |
| 2008/0251094 | A1 | * | 10/2008 | Wells et al. | 132/226 |
| 2009/0084397 | A1 | * | 4/2009 | Park | 132/250 |
| 2009/0223532 | A1 | * | 9/2009 | Takada et al. | 132/211 |
| 2011/0220142 | A1 | | 9/2011 | Park | |

OTHER PUBLICATIONS

Written Opinion of the International Searching Authority for PCT/BR2012/000414 dated Jan. 16, 2013.

* cited by examiner

AIR JET HAIR ROLLERS

CROSS REFERENCE TO RELATED APPLICATIONS

This application is a Continuation in Part of International Application No. PCT/BR2012/000414, filed Oct. 3, 2012 (which is hereby incorporated by reference).

TECHNICAL FIELD

This utility model patent is a hair roller model for use in beauty salons, homes and elsewhere, and to which an original construction was given, with a view to improving the use and efficiency compared to existing similar ones.

BACKGROUND ART

Cylindrical tube hair rollers are well known, comprised of a hollow tube and open tube ends, using hood dryer or column dryer where the air ventilates downwards drying the hair in the rollers from the root to the ends.

Notwithstanding the widespread use of this kind of hair roller, certain drawbacks can be attributed thereto, such as, for instance, a certain difficulty in drying hair taking up much time and consequently more electric energy.

Another problem of usual hair rollers consists of the fact of drying hair with hood or column dryers and this mode makes use of 50% of the air in drying the hair rollers when the air is ventilated to dry the hair downwards, consequently the air is not only ventilated towards the hair rollers but also to the ears, face, neck and shoulders, and a client who is under facial skin treatment cannot use it.

SUMMARY OF THE INVENTION

Bearing in mind these problems and with a view to overcoming them, an air injection device was developed inside the hair rollers, the objective of the present patent, which consists of promoting in the hair roller the closure of the two sides of the hollow hair rollers with an exclusive entrance for air into the curlers for injecting the air from the inside out, having the outlet in the hollows already existing in the cylindrical tube of the hair rollers.

This form of air jet hair rollers solves the drawbacks mentioned, since the air injected inside the hair rollers to leave in the hollows dries the hair from the ends to the root, drying much faster, whereby reducing the drying time and the quantity of electric energy used and also not warming the ears, face, neck and shoulders, and the client who is under facial skin treatment may use it.

Moreover, the operation of drying the hair with the construction described is much simpler than that of conventional models, due to the fact that the parts constituted thereof, that is, the closure of the ends of the cylindrical tube of the hair roller with an adaptor having an exclusive entrance to inject the air inside the hair rollers, interconnecting to a hose, and the hose interconnected to a diffuser, the diffuser to a dryer and so on, which does not usually exist in current models.

BRIEF DESCRIPTION OF THE DRAWINGS

The accompanying drawings show the arrangement of the air jet hair rollers, the objective of the present patent, and wherein.

DETAILED DESCRIPTION

Figure 1:
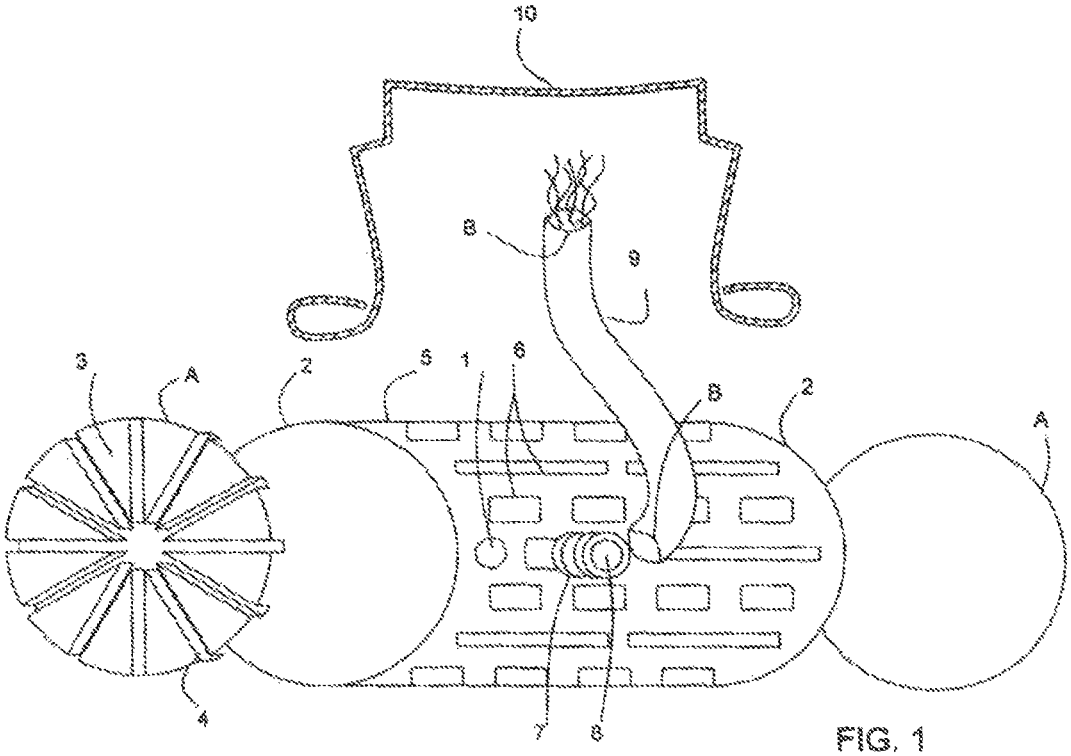
FIG. 1 shows it in blown up perspective.

As illustrated in the drawings listed above, the air jet hair roller, object of the present patent, consists of closing the ends 2 of the hollow cylindrical hair roller tube 5 with closures A. Each of the closures A of the ends 2 of the cylindrical hair roller tube 5 has a division 3 of equal parts with grooves 4 for placing the clamp 10 which fastens the cylindrical hair roller tube 5 to the hair. The hair roller tube 5 has a hole 1 formed therethough that receives an adapter 7 having a hollow core 8 through which the air injected inside the cylindrical tube hair roller 5 will pass.

In the present arrangement of cylindrical tube hair roller 5 with closures A of the ends 2 of the hair roller tube 5 with some equal divisions 3, with grooves 4 to fasten the clamp 10 when curling the hair on the hair roller tube 5. The hair roller tube 5 has a hole 1 in the cylindrical hair roller tube 5 that the hollow core 8 of the adapter 7 connects to one of the ends B of the hose 9 where the air is injected.

Figure 2:
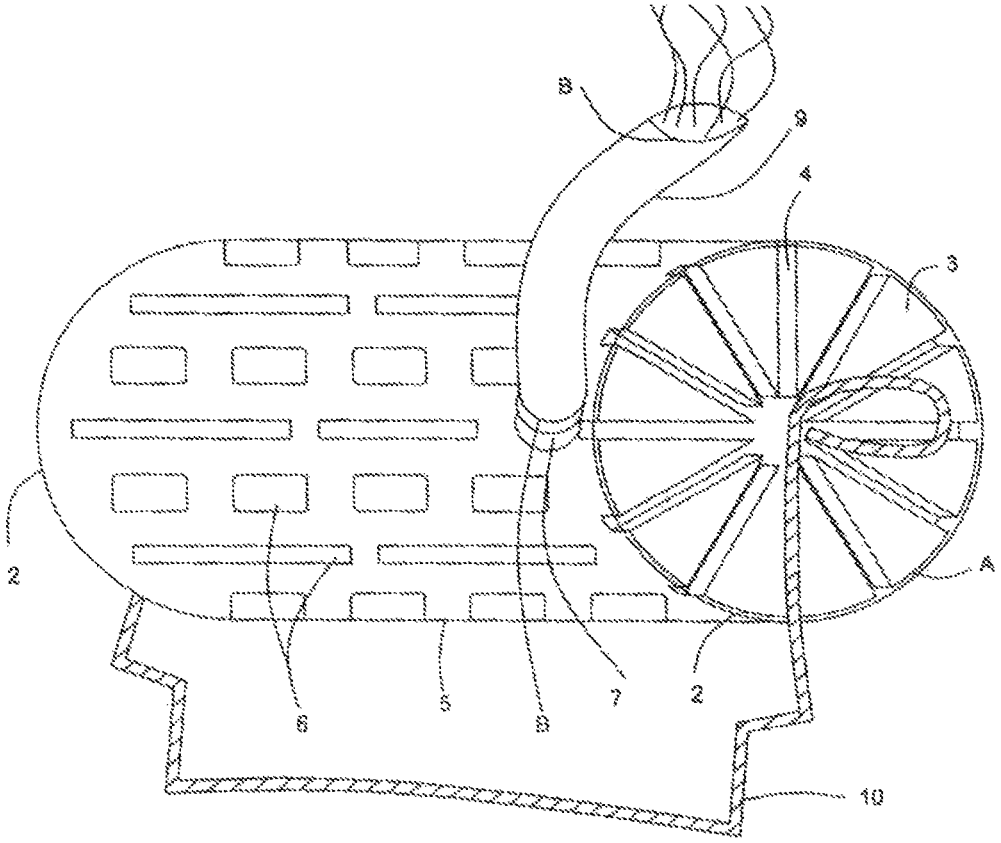
FIG. 2 shows it assembled in perspective.
Figure 3:
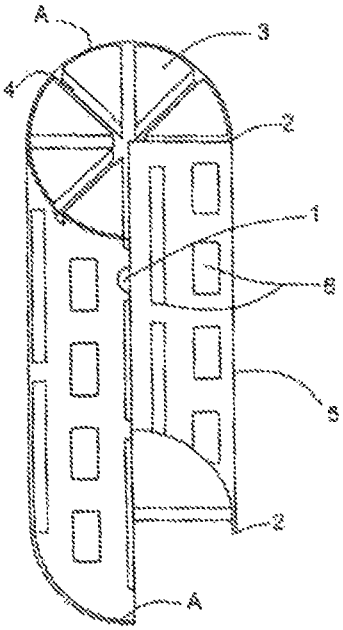
FIG. 3 shows it assembled in cut-off.
Figure 4:
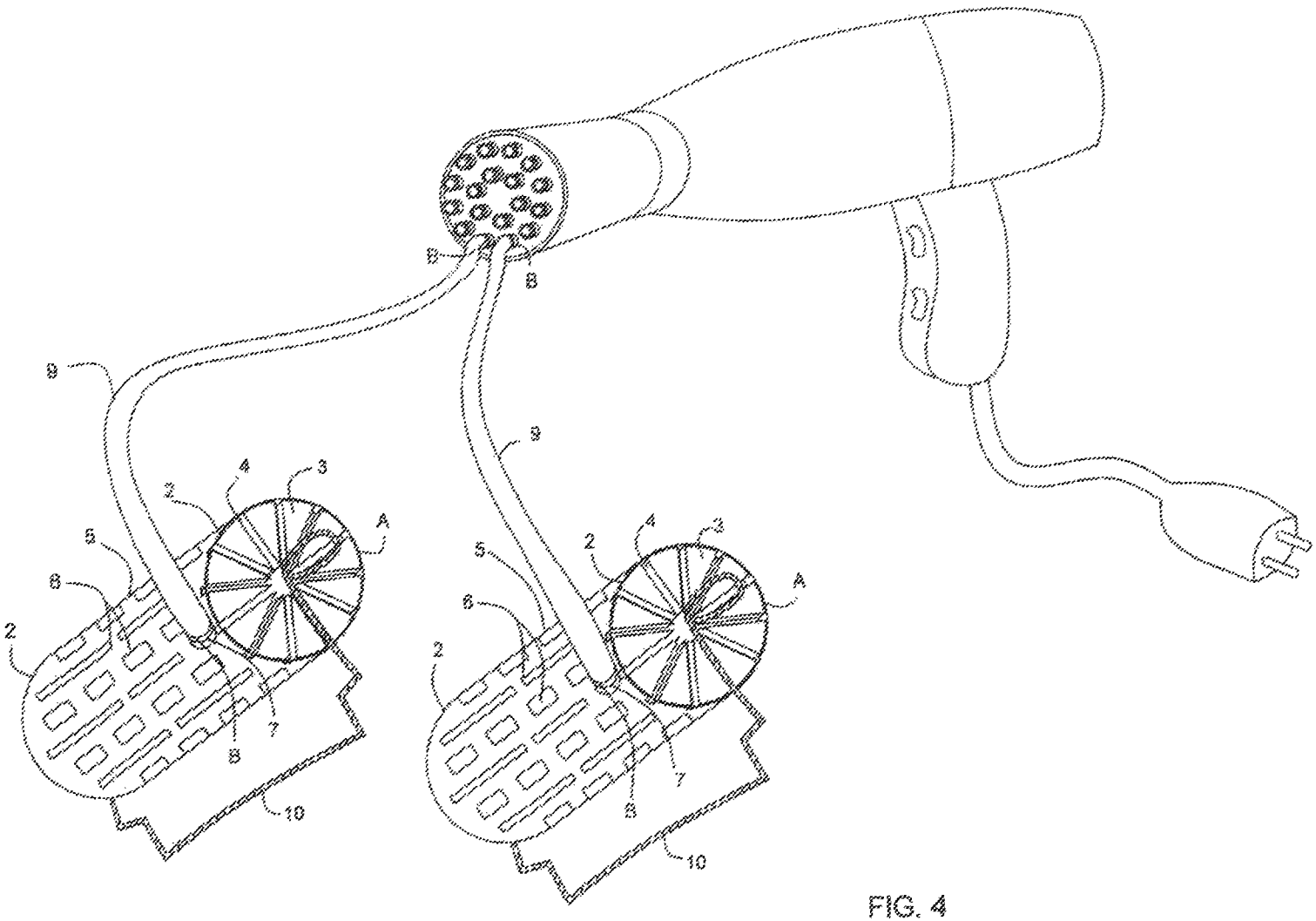
FIG. 4 shows it assembled in complete perspective of its functionality.

Thus, the hair rollers function like the usual ones, that is, they receive the air to dry the hair in an inverted manner from the ends to the root having 100% utilization of the air injected to dry the hair on the hair roller injecting the air into the hose 9 connected to the adapter 7 being injected into the core 8 of the adapter 7 and via the hole 1 (FIG. 2) into the cylindrical hair roller tube 5 and, with the hair roller tube 5 having the air blocked at the closures A of the ends 2, the air will only leave through the openings 6 of the cylindrical hair roller tube 5.

Logically, the hair roller with such construction can be obtained in various sizes and diameters to meet the different needs of users of this type of equipment.

The invention claimed is:

1. A hair roller for curling hair, the hair roller comprising:

a hollow, tubular body having a generally cylindrical outer wall extending between opposite first and second longitudinal ends of the tubular body about a common longitudinal axis, the tubular body defining a hollow chamber therewithin, the outer wall having a first hole formed therethrough to provide fluid communication with the hollow chamber and a plurality of vent openings formed therethrough to provide fluid communication between the hollow chamber and the ambient atmosphere;

first and second generally circular end closures respectively connected to the first and second longitudinal ends of the tubular body, the first and second end closures respectively sealing the first and second longitudinal ends of the tubular body to prevent air flow through the first and second longitudinal ends of the tubular body; and an annular adapter having a first open end, a second open end, and a hollow channel extending therethrough from the first open end to the second open end, the first hole that is formed through the outer wall of the tubular body being configured to receivably engage the first open end of the adapter, and wherein the second open end of the adapter is configured to interconnect with a first end of a conduit such that, upon the first hole receivably engaging the first open end of the adapter, the adapter facilitates a flow of air being delivered from the conduit through the outer wall into the hollow chamber via the first hole and out of the hollow chamber through the outer wall via the vent openings, wherein each of the first and second end closures comprises an associated end face, the associated end face of each end closure having a plurality of grooves formed therein that radially extend from a center area of the end closure that is aligned with the common longitudinal axis to the outer wall of the tubular body at the respective longitudinal end of the tubular body, and wherein the grooves formed in the associated end faces of the first and second end closures are configured to secure a hair fastening clamp to the hair roller.

2. The hair roller of claim 1, wherein the grooves formed in the associated end face of each of the first and second end closures are configured so that the distance between each groove along the circumference of said associated end face is the same.

3. The hair roller of claim 1, wherein the second open end of the adapter is configured to interconnect with a first end of a conduit that is configured to connect to a diffuser that is configured to connect to a hair dryer that is configured to deliver heated air into the conduit via the diffuser for injection as the flow of air is delivered into the hollow chamber of the tubular body.

4. The hair roller of claim 1, wherein the plurality of vent openings formed through the outer wall of the tubular body are formed as elongate slots that extend parallel to the common longitudinal axis.

5. The hair roller of claim 4, wherein the plurality of vent openings are of varying dimensions.

* * * * *